US009714495B2

(12) United States Patent
Mellier et al.

(10) Patent No.: US 9,714,495 B2
(45) Date of Patent: Jul. 25, 2017

(54) PRE-STRESSED MOLDED WALL, AND METHOD FOR CREATING SUCH A WALL

(71) Applicant: SOLETANCHE FREYSSINET, Rueil Malmaison (FR)

(72) Inventors: Erik Mellier, Rueil Malmaison (FR); Thierry Jeanmaire, Rueil Malmaison (FR); Memphis Loygue, Rueil Malmaison (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 0 days.

(21) Appl. No.: 14/772,787

(22) PCT Filed: Feb. 28, 2014

(86) PCT No.: PCT/FR2014/050442

§ 371 (c)(1),
(2) Date: Sep. 4, 2015

(87) PCT Pub. No.: WO2014/135768

PCT Pub. Date: Sep. 12, 2014

(65) Prior Publication Data

US 2016/0010302 A1 Jan. 14, 2016

(30) Foreign Application Priority Data

Mar. 5, 2013 (FR) ..... 13 51939

(51) Int. Cl.

| | |
|---|---|
| ***E02D 5/18*** | (2006.01) |
| ***E02D 17/13*** | (2006.01) |
| ***E02D 11/00*** | (2006.01) |
| ***E02D 17/20*** | (2006.01) |

(52) U.S. Cl.
CPC ..... *E02D 5/187* (2013.01); *E02D 11/00* (2013.01); *E02D 17/13* (2013.01); *E02D 17/207* (2013.01)

(58) Field of Classification Search
CPC combination set(s) only.
See application file for complete search history.

(56) References Cited

U.S. PATENT DOCUMENTS 3,760,594 A 9/1973 Jurina

FOREIGN PATENT DOCUMENTS

| | | | | |
|---|---|---|---|---|
| DE | 2028088 A1 | | 12/1970 | |
| DE | 1957789 A1 | | 2/1972 | |
| DE | 2357709 A1 | | 5/1975 | |
| GB | 1466112 A | * | 3/1977 | ..... E02D 5/18 |

OTHER PUBLICATIONS

Specification Translation—DE 2357709.*

* cited by examiner

*Primary Examiner* — Kyle Armstrong
(74) *Attorney, Agent, or Firm* — MH2 Technology Law Group, LLP

(57) ABSTRACT

The invention relates to a prestressed diaphragm wall in the ground (10) including a concrete panel (52), at least one anchor tube open at its upper end (38) and closed at its lower end (36) and, embedded at least partially in the concrete panel, at least one cable (60) extending inside the anchor tube (30), a lower portion of the cable (60) being fixed to said tube (30), and a cable anchoring system (90), configured to hold the cable in tension (60) and secure its upper portion (68) to the upper portion of the concrete panel (52). It also relates to a method for making a prestressed diaphragm wall.

26 Claims, 7 Drawing Sheets

PRE-STRESSED MOLDED WALL, AND METHOD FOR CREATING SUCH A WALL

TECHNICAL FIELD

The present invention relates to the field of special work in the ground.

More particularly, the present invention relates to a diaphragm wall and a means for making such a wall.

In the present application, a diaphragm wall means concrete work, particularly a wall, generally but not necessarily made of reinforced concrete, cast directly in the ground.

BACKGROUND OF THE INVENTION

Diaphragm walls have been known for a long time. The method for making them is always substantially identical: an excavation with a profile corresponding to that of the wall that one desires to obtain is formed in the ground. Stability of the excavation during the drilling operation is obtained by means of filling it with a liquid called "mud," generally based on bentonite. This mud forms a sealed deposit on the walls of the excavation that prevents it from percolating into the ground and prevents collapse of the walls. When the depth of the excavation has reached the desired level, the excavation is progressively filled with concrete, beginning below the mud in the bottom of the excavation.

In service, a diaphragm wall is subjected to loads, and particularly to tension forces, which can cause it to crack, and in more serious cases can fracture the concrete. The work is then in danger of deforming, threatening the integrity of adjoining structures.

One means of limiting cracking consists of increasing the strength of the work by increasing its dimensions. But this brings about an increase in the resources and the space needed for making it.

OBJECT AND SUMMARY OF THE INVENTION

One goal of the invention is therefore to provide a diaphragm wall having, with equal dimensions, an increased resistance to cracking. The invention also has the object of providing a method for making such a diaphragm wall.

This goal is attained with a method for making a prestressed diaphragm wall in the ground, including at least the following steps:

an excavation is made in the ground with a profile corresponding to that desired for the diaphragm wall, at least one anchor tube, open at its upper end and closed at its lower end, is placed in the excavation, so that its lower end is directed toward the bottom of the excavation, concrete is poured into a volume of the excavation outside the anchor tube, so as to form a concrete panel, a cable is placed inside the anchor tube, a lower portion of the cable is fixed to a lower portion of the anchor tube, after fixing, tension is exerted on the cable so as to place the cable in tension, and the cable is blocked in tension with respect to the concrete panel.

In the method according to the invention, a prestressing cable is anchored, at its lower end, directly inside the concrete panel of the diaphragm wall.

When the cable is placed in tension and blocked in that position, generally after hardening of the concrete, the concrete located between the lower portion of the cable and the upper face of the wall is compressed. The diaphragm wall is prestressed by post-tensioning, the result being that possible cracks in the concrete have a smaller tendency to form, avoiding corrosion of the steel and degradation of the concrete.

Thanks to prestressing forces, the deformations of the diaphragm wall are sharply limited, thus preserving the integrity of adjoining structures. In particular, by positioning the tube and thus the prestressing cable with an offset with respect to the median plane of the concrete panel (median plane parallel to the longitudinal faces of the panel), prestressing can be eccentric so as to compress more particularly the face(s) of the work subjected to tension forces.

Moreover, anchoring of the cable being accomplished directly in the concrete panel, the nature of the underlying soil has no influence on the implementation of prestressing.

The pipe used in the present invention should be understood to mean any hollow and elongated member. It is not necessarily cylindrical.

Advantageously, however, it will have a substantially constant cross-section over its entire length, generally circular, characterized by a nominal diameter.

The nominal diameter of the tube can correspond, for example, to its minimum external diameter.

Generally, the tube has any shape allowing good circulation of the surrounding fluids, in particular the drilling mud during its return toward the opening of the excavation, and of the concrete during the concreting operation.

The tube is not necessarily made up of a single rectilinear segment. In certain specific cases, it can consist of a plurality of substantially rectilinear parallel segments, interconnected by elbows. Because of these arrangements, it is possible for example to make the prestress eccentric over a limited wall height.

According to one advantageous provision of the invention, the anchor tube includes a plurality of annular beads formed at its periphery.

In this case, the anchor tube has a nominal diameter and, locally at its annular beads, a greater diameter than said nominal diameter.

Advantageously, the anchor tube consists of a plurality of cylindrical segments with a diameter substantially equal to the nominal diameter, interspersed with annular beads with a diameter greater than said nominal diameter.

Preferably, the beads are formed along the lower portion of the anchor tube, in other words on the portion of the tube to which the lower portion of the cable is fixed.

Advantageously, the beads are distributed over a limited length of the anchor tube, particularly on a length not exceeding one-third, preferably one-fifth, of the total length of the anchor tube.

Preferably, the beads are positioned one above the other and have the same diameter.

Preferably, to further improve the quality of the anchoring, the inner wall of the lower portion of the anchor tube forms a plurality of annular cavities positioned one above the other.

The beads improve adhesion of the tube to the concrete. During tensioning of the cable, they participate in transferring tension forces. Once the cable is blocked under tension, they participate in distributing compression forces in the concrete panel.

Advantageously, so that anchoring is improved, the outer diameter of the tube at the beads is greater than 1.05 times the nominal diameter of the tube.

Preferably, moreover, the outer diameter of the tube at the beads remains limited to avoid the formation, between two adjoining beads, of "dead zones" where the drilling mud could risk becoming trapped during the concreting operation.

Advantageously, the outer diameter of the tube at the beads does not exceed 1.3 times the nominal diameter of the tube. The limited radial height of the protrusions makes it possible to ensure good circulation of concrete during concreting. The concrete can easily reach all the zones of the excavation to replace the drilling mud there.

Preferably, the outer diameter of the tube at the beads is comprised between 1.1 and 1.3 times, more preferably between 1.15 and 1.25 times, its nominal diameter.

More generally, the beads have any shape and any dimensions suited to ensure good circulation of the mud and of the concrete during concreting.

Advantageously, in an axial plane of the tube, the angle formed at each lower or upper end point of a bead, between the outer surface of the adjoining tube at said end and the tangent to the bead at the end point, is greater than 90°, preferably than 120° and even more preferably than 135°.

Diaphragm walls are most often made of reinforced concrete. In this case, the anchor tube is fixed to a reinforcement cage before introducing it into the excavation jointly with said reinforcement cage. The tube can thus be positioned accurately inside the excavation and ultimately inside the concrete panel of the diaphragm wall.

As indicated earlier, in one step of the method according to the invention, a lower portion of the cable is fixed to a lower portion of the anchor tube. In other words, these two elements are joined together directly, or indirectly through a connecting element which can in particular be a sealing material.

According to one example, to attach the lower portion of the cable to the lower portion of the anchor tube, at least the lower portion of the anchor tube is filled with a sealing material, so that the lower portion of the cable is coated by said sealing material. The portion of the tube filled with the sealing material forms a sufficiently long anchoring segment to transfer the tensile forces applied to the cable. These tension forces are transmitted to the concrete by adhesion and additionally, possibly by the beads provided at the periphery of the tube.

Preferably, the remaining height of the anchor tube is filled with a filling material, which can be the sealing material contained in the lower portion of the tube, or a different material. In this case, the cable is advantageously sheathed between its lower portion and the upper end of the concrete panel. When the cable is stretched, it deforms and extends. The sheathing allows relative displacement of the cable compared to the concrete panel. When the cable is put under tension, it slides in the sheathing without degrading the filling material that surrounds it.

According to one example, the cable consists of a plurality of strands.

To improve fixing of the cable to the tube, it is possible, before insertion of the cable inside the anchor tube, to separate the strands from one another using a spacer on the lower portion of the cable intended to be positioned in the lower portion of the anchor tube.

The present invention also relates to a prestressed diaphragm wall in the ground, obtained by implementing the method defined above.

The present invention also relates to a method for making a prestressed retaining assembly including a diaphragm wall cast in the ground and a crowning structure capping said diaphragm wall, said method including at least the following steps:

making an excavation in the soil with a profile corresponding to that desired for the diaphragm wall, placing in the excavation at least one anchor tube open at its upper end and closed at its lower end, so that its lower end is directed toward the bottom of the excavation, concrete is poured into a volume of the excavation outside said anchor tube, so as to form a concrete panel, after the concrete panel hardens, a crowning structure capping the upper face of the concrete panel is made so that the interior of the anchor tube remains accessible from the upper surface of said structure, placing a cable inside the anchor tube, fixing a lower portion of the cable to a lower portion of the anchor tube, exerting tension on the cable so as to place the cable under tension, and blocking the cable in tension with respect to the concrete panel and to the crowning structure.

In this method, the cable can be positioned and/or fixed inside the anchor tube either before making the crowning structure before or after concreting the concrete panel or once the crowning structure is finished.

According to one exemplary embodiment of the invention, the anchor tube is positioned so that its upper end is flush with the upper face of the crowning structure.

According to another exemplary embodiment, the upper end of the tube is sealingly coupled with a hollow extension element, positioned so that its upper end is flush with the upper end of the crowning structure. The hollow extension element can be an anchoring trumpet generally referred to by the term "trumplate".

The present invention also relates to a prestressed diaphragm wall in the ground, including a concrete panel, at least one anchor tube, open at its upper end and closed at its lower end, and embedded at least partially in the concrete panel, at least one cable extending inside the anchor tube, a lower portion of the cable being fixed to said tube, a system for anchoring the cable, configured to maintain the cable in tension and secure its upper portion to the upper portion of the concrete panel.

According to one exemplary embodiment, the diaphragm wall also includes a reinforcement cage embedded in the concrete panel, the anchor tube being secured to the reinforcement cage.

To improve its adhesion to the concrete, the anchor tube can include a plurality of annular beads formed at its periphery.

Preferably, the annular beads are formed along the lower portion of the anchor tube, in other words on the portion of the tube to which is fixed the lower portion of the cable.

It should be noted that other preferred characteristics relating to the tube defined previously in connection with the process for making the diaphragm wall are also applicable to the diaphragm wall according to the invention.

As indicated above, the anchoring system of the cable is configured to secure the upper portion of the cable to the upper portion of the concrete panel.

According to one example, a sealing material can fill at least the lower portion of the anchor tube and coat at least the lower portion of the cable. Preferably, so as to avoid corrosion, the remaining height of the anchor tube is filled with filling material, particularly said sealing material filling the lower portion of the anchor tube. According to one variant, the filling material can also be a different material from the sealing material.

To allow deformation of the cable despite the filling material that coats it, the cable can be sheathed between its lower portion and the upper end of the concrete panel.

According to one example, the anchoring system of the cable is located outside the concrete panel, maintaining the cable in tension and joining its upper portion to the upper face of the concrete panel. Such an anchoring system typically includes a cable blocking device, including in particular a wedge system and possibly a support plate for this device, designed to distribute forces, and particularly to avoid concentration of forces over the cable blocking device.

Finally, the present invention relates to a prestressed retaining assembly including a diaphragm wall as defined above, and a crowning structure capping said diaphragm wall, the cable passing through said crowning structure and the system for anchoring the cable being secured to the upper portion of said structure.

According to an advantageous embodiment, the anchoring system of the cable is supported against the upper surface of the crowning structure.

Several embodiments and implementation modes are described in the present disclosure. However, absent any statement to the contrary, the features described in relation with any embodiment or implementation mode can be applied to any other embodiment or implementation mode.

BRIEF DESCRIPTION OF THE DRAWINGS

The invention will be better understood upon reading the following description of the invention given by way of a non-restricting example, with reference to the appended drawings, wherein.

Figure 1:
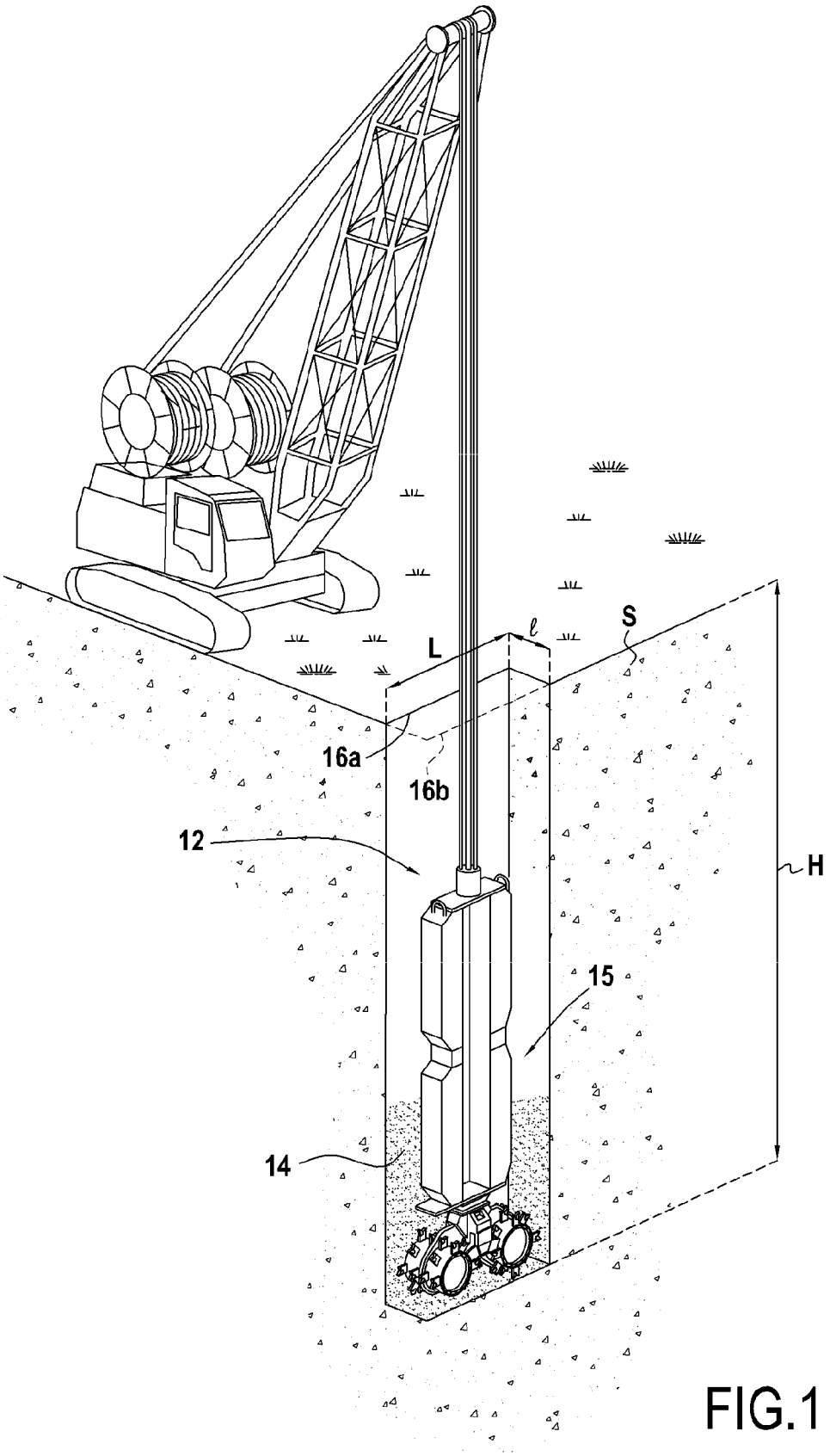
FIG. 1 is an overall view illustrating the step consisting of excavating the ground.

A first phase of the process of making a diaphragm wall 10 according to an implementation of the invention is shown in FIG. 1.

It consists of making, in the ground S, an elongated excavation 12, showing the future placement of the diaphragm wall 10. In the example, the excavation 12 is dug vertically. It includes two longitudinal walls 16*a*, 16*b* of length L, spaced by a constant distance I. The height H of the excavation depends on the total height desired for the wall 10.

Depending on the terrain and the specifications, various tools can be used to dig the excavation 12, for example a "Hydrofraise" 15, as illustrated in FIG. 1, or a cable grab, a Kelly grab, etc.

To ensure the stability of the excavation 12 during the drilling operation and in particular to avoid collapse of the walls 16*a*, 16*b*, the excavation 12 is filled during drilling with a mud 14 generally based on bentonite.

In the example, and in most cases, the diaphragm wall 10 is made of reinforced concrete. In the second step, therefore, a reinforcement cage 18 is provided, intended to be accommodated in the excavation 12.

The dimensions of the reinforcement cage 18 are selected so that, once positioned in the excavation 12, its lateral faces and its bottom are positioned parallel to the walls of the excavation 12 and at sufficient distance from them that the end reinforcements of the cage 18 can be properly coated during concreting of the excavation 12.

Before its descent into the excavation, the reinforcement cage 18 is held vertical by the hangers 22 of a lifting device 20 cooperating with the lifting bail 24 provided at the upper end of the cage 18.

In a third phase, several anchor tubes 30 (hereafter "tubes") are tied to the reinforcement cage 18. The tubes 30 are fixed to the cage 18, so as to extend parallel to the lateral walls of the excavation 12 once inside it. In the example, the tubes 30 are therefore placed parallel to one another, vertically.

In the example illustrated, more particularly, the tubes 30 are aligned with a median plane of the excavation, parallel to the longitudinal walls 16*a*, 16*b*.

In the present disclosure, absent any statement to the contrary, the adjectives upper and lower are used with reference to the drilling direction of the excavation or to the direction of introduction of the tube 30 into the excavation, the tube being introduced by its lower end, with its upper end toward the entrance of the excavation 12.

Figure 3:
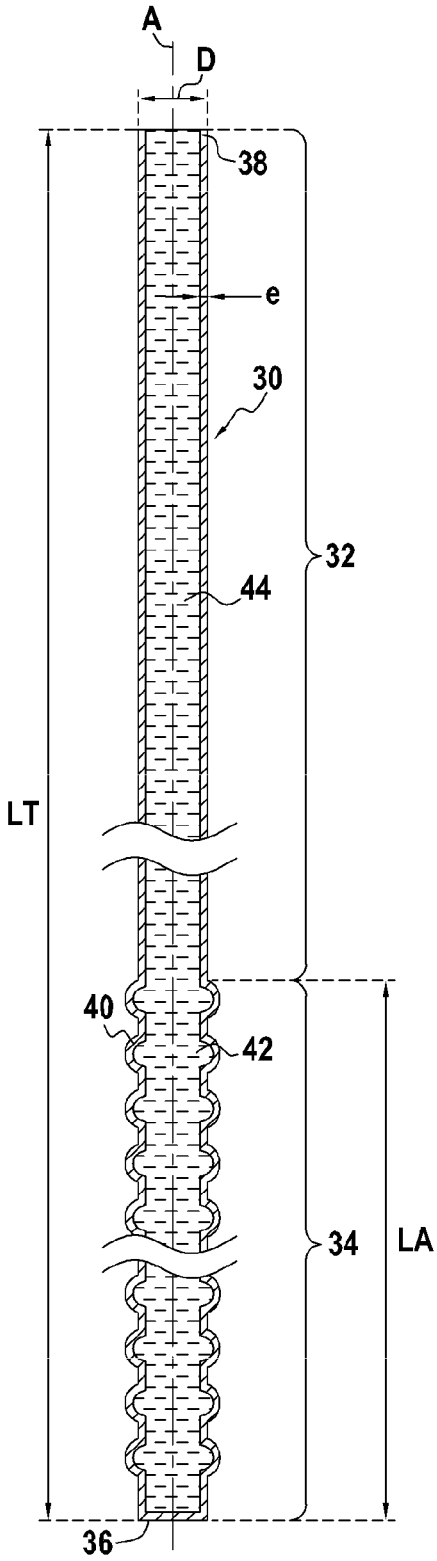
FIG. 3 is a section view of a tube of FIG. 2.

One example of a tube 30 which can be used in the present invention is illustrated in more detail in FIG. 3.

The tube 30 is made of metal.

In the example, it includes an upper portion 32 with a constant diameter and having a smooth outer surface, and a ringed lower portion 34.

By the lower portion of an element, particularly a tube 30 with axis A, what is generally meant is a portion located in the lower half, in its longitudinal direction.

In the same manner, what is generally meant by the upper portion of an element, particularly a tube 30, is a portion located on its upper half in its longitudinal direction.

In the example illustrated, the ringed portion 34 extends to the lower end 36 of the tube 30. According to the embodiment variants, the tube 30 can include, near its lower end 36, a smooth portion that is not ringed. The ringed portion will begin in this case at a certain distance from the lower end 36 of the tube 30.

Here, the length LA of the ringed portion 34 has less than one third of the total length LT of the tube 30. Preferably, it represents less than a fifth of the total length LT of the tube.

For the remainder of the present description, the nominal diameter D of the tube 30 is defined as being, for example, the diameter of the tube 30 on its non-ringed portion, here its upper portion 32. It can also be considered, particularly in the case where the tube 30 is ringed over its entire length, that the nominal diameter D of the tube 30 corresponds to its smallest diameter.

The tube 30 includes, on its lower portion 34, a plurality of annular protrusions or beads 40. Locally, at each of these beads 40, the tube 30 has a greater diameter than the nominal diameter D of the tube 30, particularly a diameter comprised between 1.1 and 1.3 times, preferably 1.15 to 1.25 times its nominal diameter D.

In the example illustrated, the beads 40 are arranged one over the other and the diameter of the tube 30 is identical at each bead 40.

The thickness e of the wall of the tube 30 remaining substantially constant over its entire height, an annular cavity 42 is formed inside the tube 30 at each bead 40.

In the example, this configuration is obtained by heating the tube 30 locally, then applying to it an axial compression force, causing it to buckle.

For reasons that will be explained hereafter, the tube 30 is plugged at its lower end 36 and open at its upper end 38.

In other words, the end 36 of the tube 30 oriented toward the bottom of the excavation 12 is closed, while its end 38 pointing toward the entrance of the excavation 12 is open.

The length LT of the tube 30 depends on the height of the diaphragm wall to be made and therefore on the height of the excavation 12. Preferably, it is selected to that the lower end 36 of the tube 30 is located at a nonzero distance Lr from the bottom of the excavation 12. Depending on the case, the distance Lr can be relatively small (typically a few tens of centimeters) or greater (for example in the case of a wall having an essentially hydraulic function in its lower portion, and a retaining function only in its upper portion).

Figure 2:
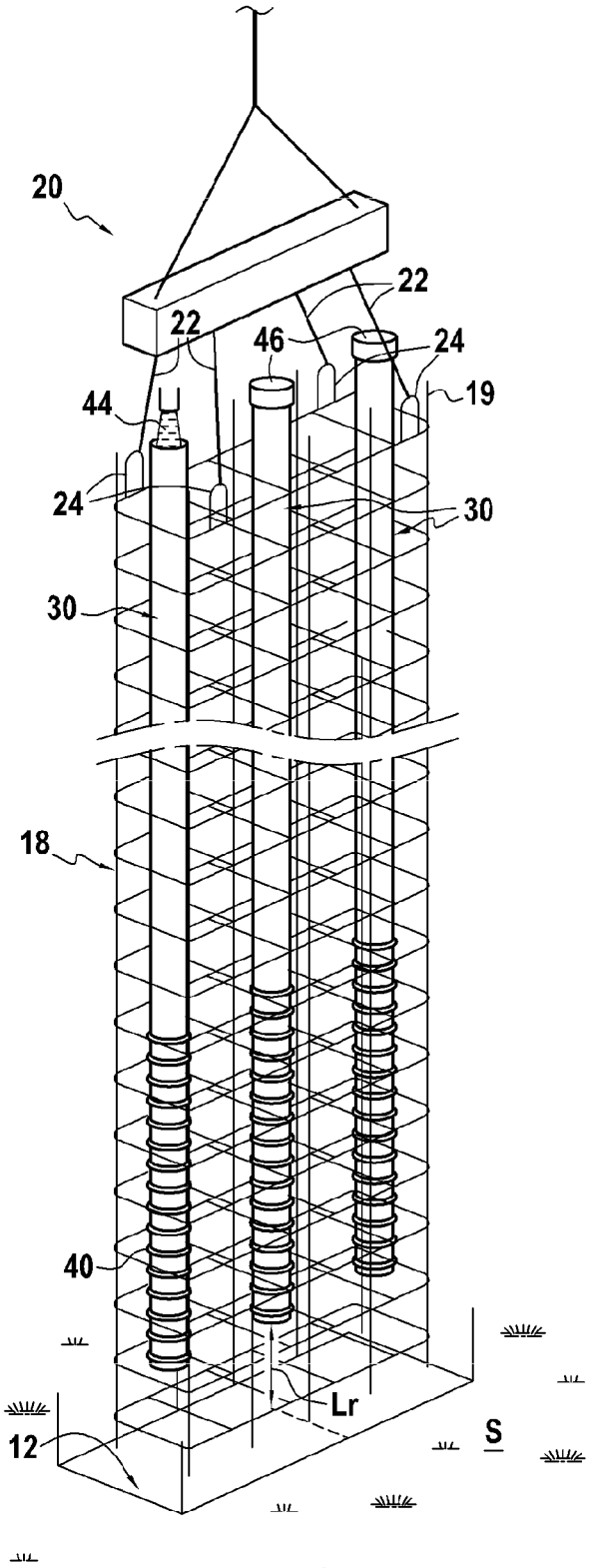
FIG. 2 illustrates fixing the tubes to the reinforcement cage, as well as filling and plugging the tubes.

In a fourth phase of the method illustrated in FIG. 2, the tubes 30 are filled with a standby liquid 44, generally water, then their upper end 38 is plugged using a plug 46.

Figure 4:
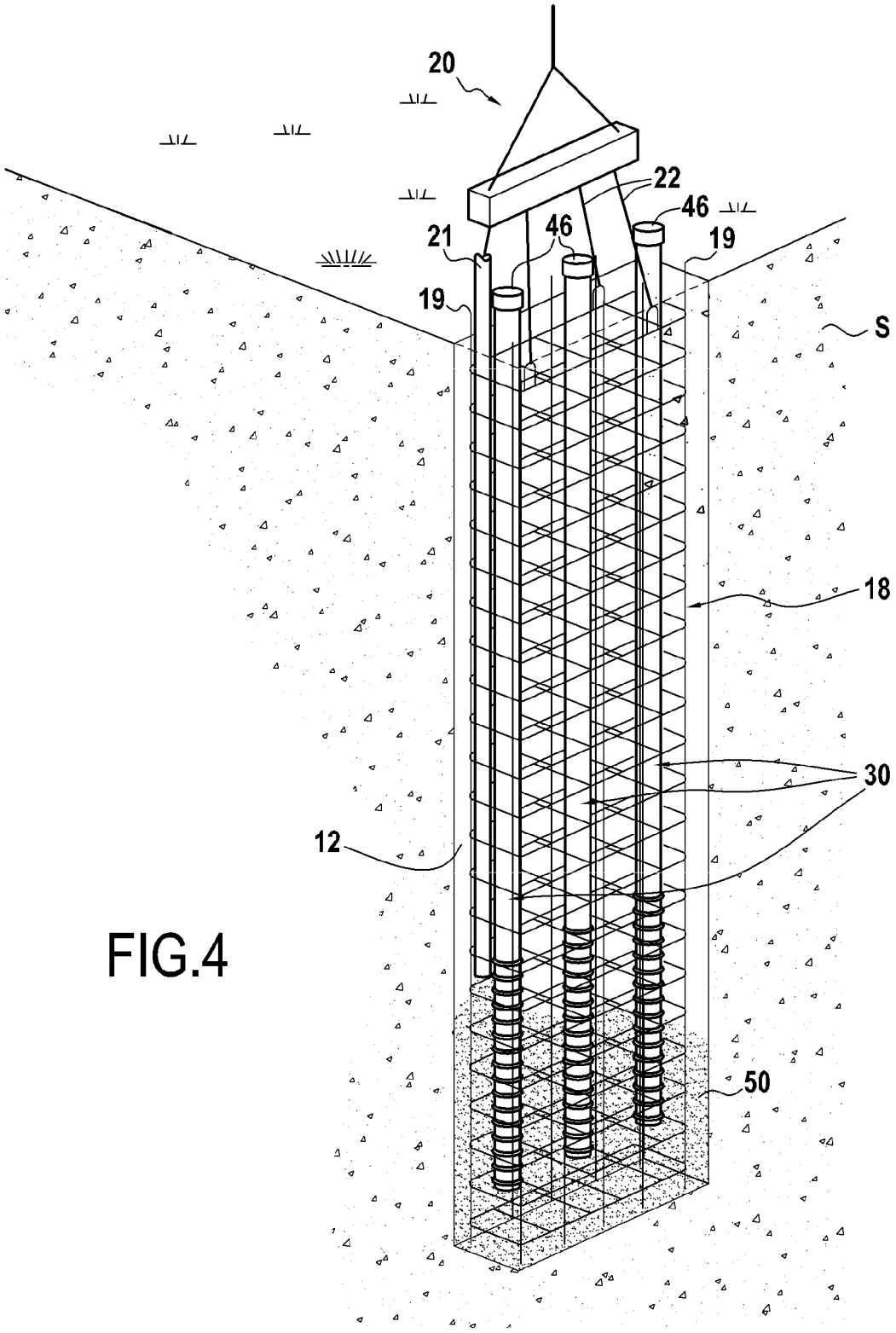
FIG. 4 shows the assembly formed by the reinforcement cage and the tubes once positioned in the excavation, as well as the step of concreting the excavation.

In a fifth step illustrated in FIG. 4, the reinforcement cage 18 and the tubes 30 joined to this cage 18 are finally introduced into the excavation 12, progressively, by means of the lifting device 20. As indicated previously, to allow satisfactory coating of its reinforcements and to avoid having them deform, it is necessary that the reinforcement cage 18 remain at a certain distance from the bottom and the walls of the excavation 12.

In a sixth phase also shown in FIG. 4, once the reinforcement cage 18 and the tubes 30 are put in place, concrete 50 is poured beginning below the bentonite mud 14, at the lower end of the excavation 12, using a plunger tube 21. The concrete 50 gradually coats the reinforcement of the reinforcement cage 18 and the tubes 30, and forms a concrete panel 52. Preferably, the diameter to thickness ratio D/e of the tube is selected to avoid their buckling under the pressure of the concrete and to ensure the quality of adhesion between the concrete and the tubes.

Once the concrete 50 is hardened, a cable 60 is introduced into the interior of each tube 30.

In the example, the cable 60 consists of a plurality of parallel strands 62 distributed along a longitudinal axis X.

Figure 5:
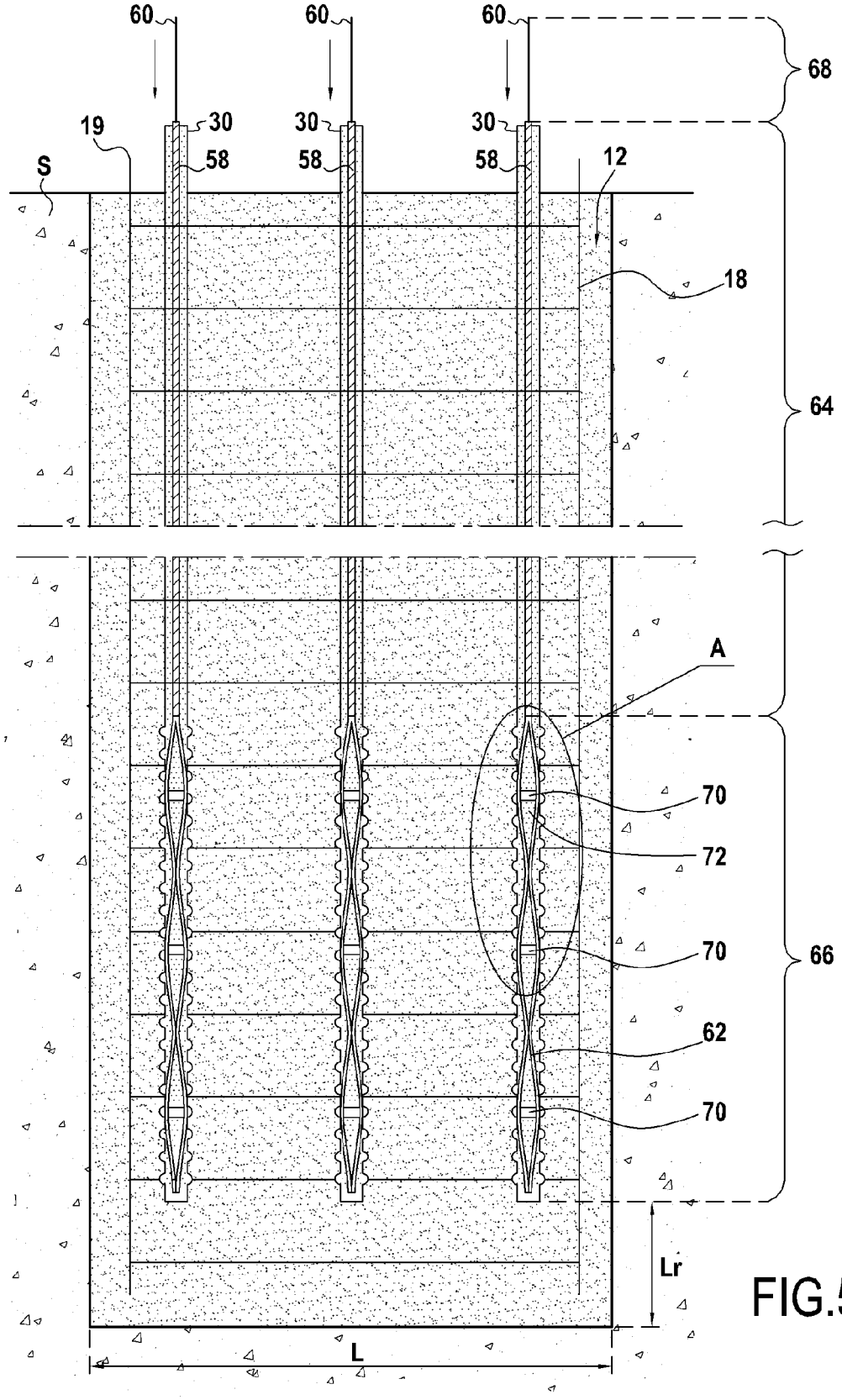
FIG. 5 is a section view of the excavation after the cables have been inserted into the tubes.
Figure 5A:
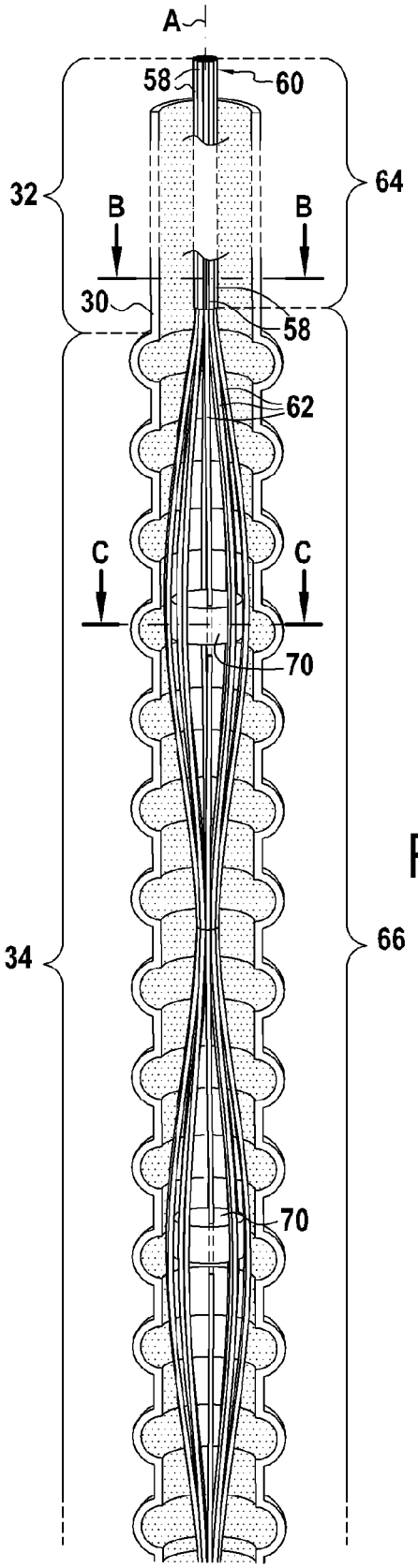
FIG. 5A is a detail view of the cable inside a tube.
Figure 5B:
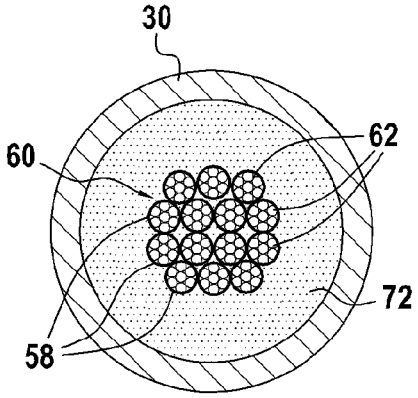
FIG. 5B is a section view along BB in FIG. 5A.

In the example, and as illustrated in FIGS. 5 and 5A, a central portion 64 of the cable, called the "free portion," is sheathed and lubricated, generally each strand 62 is surrounded by a sheath 58 and lubricated within that sheath 58.

On the other hand, the strands 62 are bare and not lubricated on a lower portion 66 and on an upper portion 68 of the cable 60 located on either side of said central portion 64.

Figure 5C:
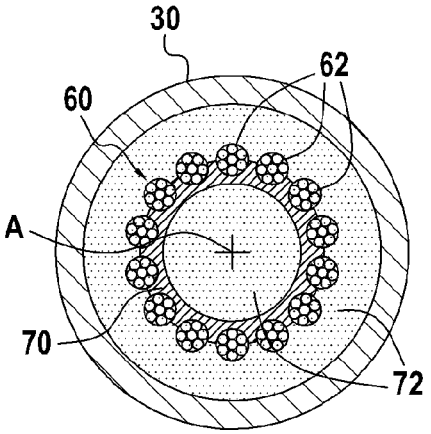
FIG. 5C is a section view along CC in FIG. 5A.

In a seventh phase of the method, before inserting the cable 60 inside the tube 30, the strands 62 are locally spaced one from the other by means of a spacer 70, on a lower end portion 66 of the cable 60. The separation of the strands 62 is illustrated in more detail in FIGS. 5A and 5C.

In an eighth phase of the method, the cable 60 is positioned longitudinally inside the tube 30.

In the example, and advantageously, the lower portion 66 of the cable 60 is positioned facing the lower portion 34 of the tube 30 which includes the beads 40. In this lower portion of the tube, the strands 62 are not sheathed, not lubricated, but spaced locally using spacers 70.

In a ninth phase of the method, a sealing material 72 is introduced into the lower portion 34 of the tube 30. According to one variant, this ninth phase can be switched with the eight phase. The sealing material can be introduced into the tube before the cable is positioned there.

The sealing material 72 is for example a grout, in particular a cement grout, and particularly such a grout characterized by a cement to water ratio, by mass, greater than 2. It is also possible to use, in place of the cement grout, a resin or any other sealing material designed to ensure good anchorage of the cable 60.

The fact that the strands 62 are bare in the lower portion 66 of the tube 60 allows good adhesion to the sealing material 72. Moreover, the separation of the strands 62 at this place makes it possible to increase their contact surface with the sealing material 72 and to further increase adhesion. The lower portion 66 of the cable 60 is thus fixed to the tube 30.

As FIG. 5A also reveals, the sealing material 72 fills in the cavities 42 formed by the inner wall of the tube 30 at its lower portion 34, further improving anchoring of the cable to the tube after hardening of the material 72.

According to an advantageous embodiment, the volume of the tube 30 remaining free is filled with a filler material, which can be the sealing material 72 introduced into the lower portion 34 as in the example illustrated, or any other filler material allowing corrosion of the tube 30 and of the cables 60 to be avoided over the long term.

As described previously and illustrated in FIG. 5, to allow tensioning of the cable 60 once the sealing material 72 has hardened, the cable 60 is sheathed from its lower portion 66 up to the upper end of the tube 30, or at least up to the surface of the material 72.

In the example, the diaphragm wall 10 is capped by a crowning beam 80 made of reinforced concrete.

In this case, it is provided that standby reinforcement 19 of the reinforcement cage 18 protrudes from the upper face of the concrete panel 52. Thus, the crowning beam 80, poured on the upper face of the diaphragm wall 10, incorporates this standby reinforcement 19 as well as an upper segment of the tubes 30.

Figure 6:
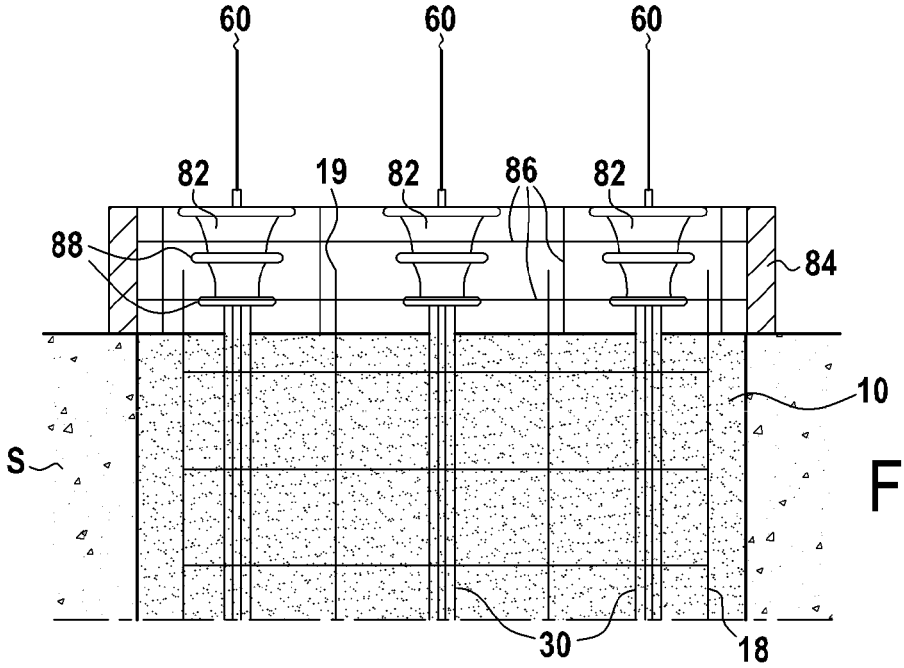
FIG. 6 shows the installation of the formwork for the crowning beam.
Figure 7:
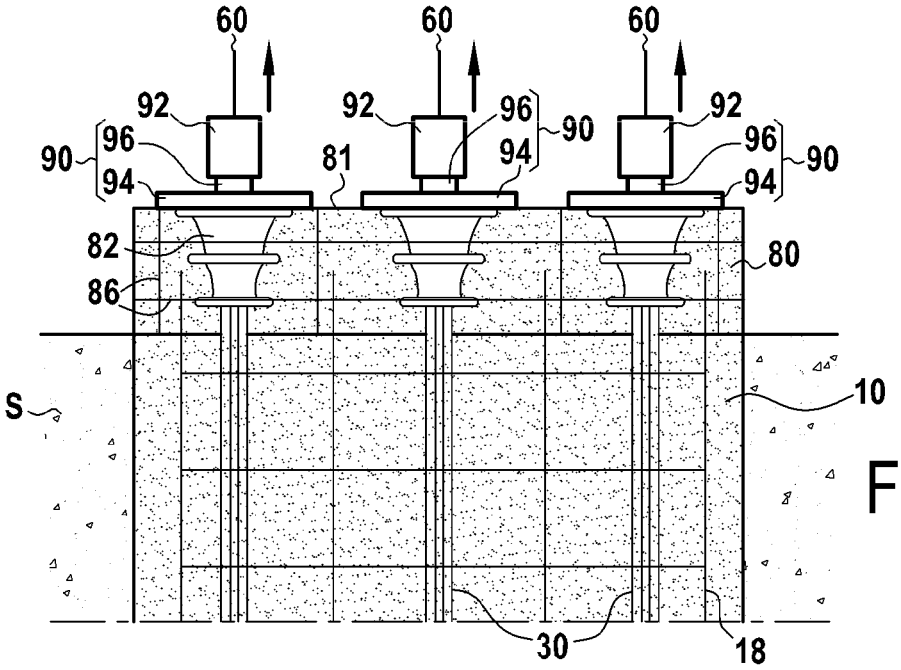
FIG. 7 shows the crowning beam after concreting, and tensioning of the cables using jacks.

As illustrated in FIG. 6, each upper end 38 of a tube 30 is connected, for example by means of a tubular connection, to an anchoring trumpet 82—generally known by the term "trumplate". The anchoring trumpet 82 is a conical or splayed metal part allowing fanning of the strands 62 of the cable 60 passing through it when leaving the crowning beam.

As illustrated in FIG. 6, the outer flanges 88 are distributed over the height of the trumpet 82. These flanges are designed to distribute forces, particularly compression forces, in the crowning beam 80.

The trumpet 82 is positioned, within the formwork 84, so that after concreting its upper end is flush with the surface of the concrete. To ensure its correct positioning during concreting, the trumpet 82 is fixed to the reinforcement 86 of the beam.

Once the crowning beam is concreted, each upper portion 68 of the cable 60 protruding from the upper face of the beam 80 is coupled to an anchoring system 90. An anchoring system 90 typically consists of a support plate 94 resting against the upper face of the crowning beam and a device for blocking the cable 96 including in particular a wedge system. According to one variant, the anchorage system may not include a support plate. In this case, the cable blocking device can for example be supported on the upper end flange of the trumpet 82.

Using jacks 92, the cables 60 are put into tension at the desired loading, then each cable 60 is blocked in the tightened position by means of its associated blockage device 96.

The jacks 92 are withdrawn. To avoid entry of water inside the anchor tubes, the anchoring systems 90 are finally covered with sealed protections 98.

The anchoring system 90 transfers the prestress force applied to the cable 60 to the concrete of the crowning beam 80 and of part of the diaphragm wall 10 located between its upper face and the lower portion of the tube 30. The concrete is compressed.

The succession of steps described above is only one non-limiting exemplary embodiment of the method according to the invention.

Other exemplary embodiments can be contemplated.

For example, the introduction, in a tube 30, of a cable and/or of the sealing material and/or of the filling material, can be accomplished after concreting of the crowning beam.

The method according to the invention makes it possible to obtain a prestressed diaphragm wall in the ground and a retaining assembly including such a wall, the features whereof are inherent in said method.

Figure 8:
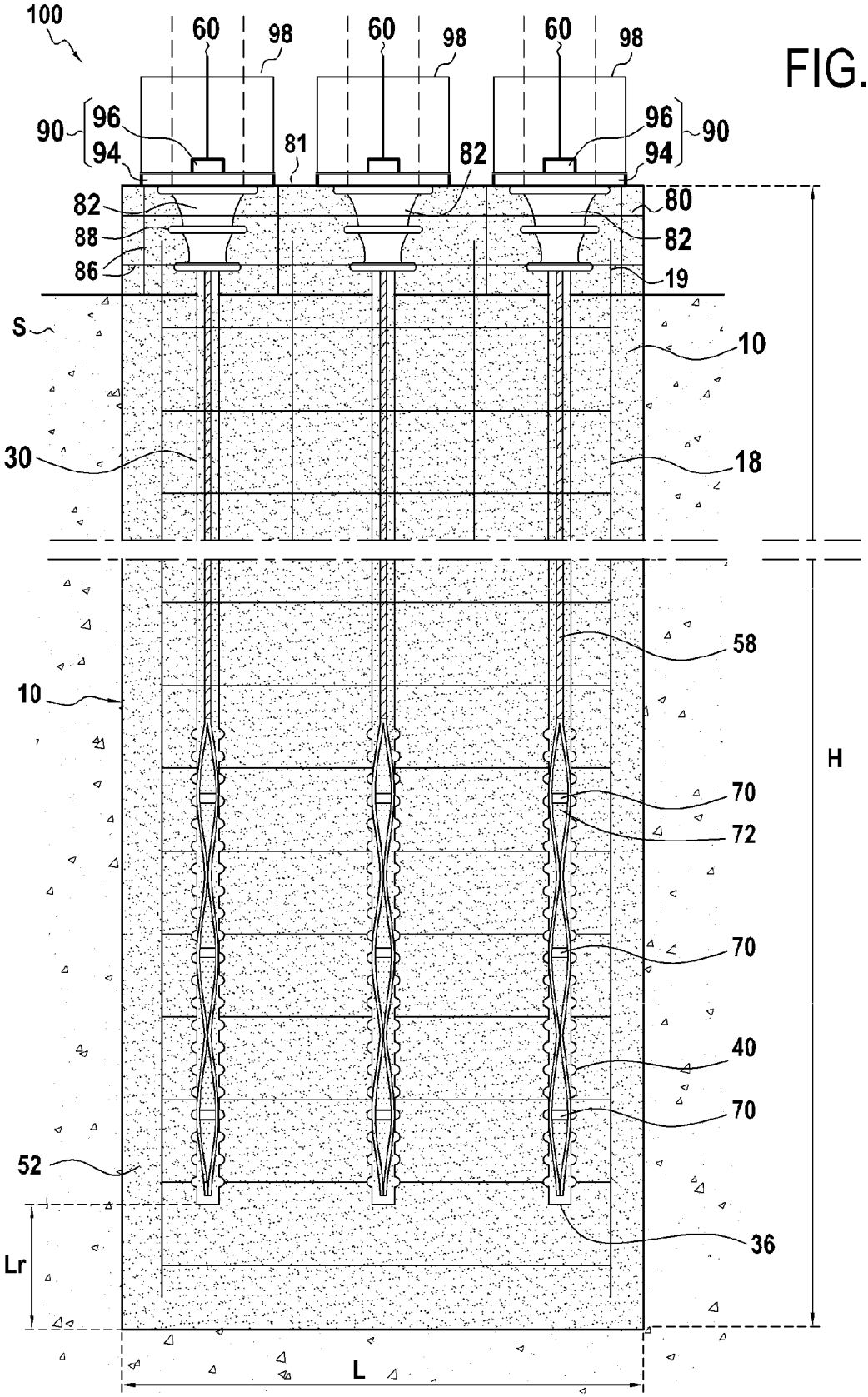
FIG. 8 shows the prestressed retaining assembly obtained after the steps of FIGS. 1 to 7.

A retaining assembly 100 thus obtained is shown in FIG. 8.

The diaphragm wall 10 includes an elongated concrete panel 52, including two longitudinal faces of length L spaced apart by a distance I. As illustrated in FIG. 8, the panel 52 has a height H, and its upper face is located below or at grade level.

The wall 10 is capped by the crowning beam 80, having here the same length L and the same thickness I.

A reinforcement cage 18 is embedded in the concrete panel 52.

To ensure the mechanical joining of the crowning beam and of the wall 10, standby reinforcement 19 from the reinforcement cage 18 is incorporated into said crowning beam 80.

Tubes 30 positioned parallel to the longitudinal faces of the concrete panel 52 are partly contained in the diaphragm wall 10 and partly in the crowning beam 80. The tubes are for example aligned in a median plane of the concrete panel, parallel to its longitudinal faces.

Their closed lower end 36 is embedded in the concrete panel 52, and spaced a predetermined distance Lr away from the lower end of the panel 52. Their open upper end 38 is contained in the crowning beam 80.

In the example, the upper end 38 of each tube 30 is connected to an anchoring trumpet 82, flush with the upper face 81 of the crowning beam 80.

One example of the tube 30 having been described in detail with reference to FIG. 3, its features will not be repeated here.

A cable 60, consisting of a plurality of strands 62, extends inside each tube 30. In the lower portion of each cable 60, the strands 62 are locally spaced by means of a central spacer 70. In this lower portion, the cable 60 is not sheathed, not lubricated, but embedded in a sealing material 72 filling a lower portion 34 of the tube 30.

The remainder of the tube 30 is filled with a filling material, for example the sealing material 72 and, on the segment located above the lower portion previously defined, the cable is sheathed.

Each cable 60 is stretched and maintained in this position thanks to the anchoring system 90 located outside the concrete panel 52, and being supported on the upper face of the crowning beam 80.

Under the influence of the cables being kept under tension, the retaining assembly 100 is compressed over the area extending axially between the lower portion 34 of the tubes 30 and the upper face 81 of the crowning beam 80.

Other exemplary embodiments, not illustrated in FIGS. 1 to 8, can also be contemplated.

For example, while making the diaphragm wall, the tubes 30 can be offset with respect to the median plane of the excavation. Preferably, in the diaphragm wall, they are positioned on the side of the longitudinal face which is in tension due to outside forces.

In certain particular cases, it is even desirable that the cable 60 be offset with respect to the median plane toward one of the longitudinal faces of the wall at a first height of the wall and toward the opposite face of the wall at a second height. The tube 30 can then consist of two parallel segments of tube connected by an elbow.

In the illustrated embodiment, the anchoring of the cable 60 in the upper portion of the work is accomplished by means of an anchoring system 90 outside the work. In the particular example considered, the distribution of compression forces in the retaining assembly is ensured, by the support plate 94 on the one hand, and the flanges 88 of the trumpet 82 on the other.

According to another exemplary embodiment, the cable 60 can be sealed to the upper portion 32 of the tube 30 in the same manner as at its lower portion 34. In this case, according to an example implementation, the lower portion of the cable 60 is fixed to the lower portion 34 of the anchor tube 30 in a first phase, for example by filling the lower portion 34 of the tube 30 with a sealing material coating a non-sheathed and non-lubricated length of the cable 60. In a second step, the cable 60 is placed in tension. Then a filler material is introduced into the tube over an entire length of cable (sheathed and lubricated or not). Finally, in a fourth phase, a sealing material is introduced into the upper portion 32 of the tube 30 so as to coat a non-sheathed and non-lubricated upper portion 68 of the cable 60.

In this case, the anchoring system is integrated into the concrete panel 52. The upper segment of the tube filled with sealing material forms an anchoring segment, which transfers forces to the concrete by adhesion and possibly, in addition, due to beads provided on its periphery.

The invention claimed is:

1. A method for making a prestressed diaphragm wall in the ground, the method comprising:

an excavation is made in the ground with a profile corresponding to that desired for the diaphragm wall, at least one anchor tube, open at its upper end and closed at its lower end, is placed in the excavation, so that its lower end is directed toward a bottom of the excavation, concrete is poured into a volume of the excavation outside said anchor tube, so as to form a concrete panel, a cable is placed inside the anchor tube, a lower portion of the cable is fixed to a lower portion of the anchor tube, after fixing, tension is exerted on the cable so as to place the cable in tension, and the cable is locked in tension with respect to the concrete panel.

2. The method according to claim 1, wherein the anchor tube includes a plurality of annular beads formed at its periphery.

3. The method according to claim 2, wherein the anchor tube has a nominal diameter and, at the beads, a diameter comprised between 1.05 and 1.3 times its nominal diameter.

4. The method according to claim 3, wherein the anchor tube has a nominal diameter and, at the beads, a diameter comprised between 1.10 and 1.3 times its nominal diameter.

5. The method according to claim 4, wherein the anchor tube has a nominal diameter and, at the beads, a diameter comprised between 1.15 and 1.25 times its normal diameter.

6. The method according to claim 2, wherein the annular beads are formed along the lower portion of the anchor tube.

7. The method according to claim 1, wherein the anchor tube is first fixed to a reinforcement cage, then the anchor tube is introduced into the excavation jointly with said reinforcement cage.

8. The method according to claim 1, wherein, to fix the lower portion of the cable to the lower portion of the anchor tube, at least the lower portion of the anchor tube is filled with a sealing material, so that the lower portion of the cable is coated by said sealing material.

9. The method according to claim 1, wherein the cable consists of a plurality of strands and, before inserting the cable into the anchor tube, the strands are spaced from one another using a spacer on the lower portion of the cable intended to be positioned in the lower portion of the anchor tube.

10. A prestressed diaphragm wall in the ground, obtained by implementing the method according to claim 1.

11. A method for making a prestressed retaining assembly including a diaphragm wall in the ground and a crowning structure capping said diaphragm wall, said method comprising:

an excavation is made in the ground with a profile corresponding to that desired for the diaphragm wall, at least one anchor tube open at its upper end and closed at its lower end is placed in the excavation, so that its lower end is directed toward a bottom of the excavation, concrete is poured into a volume of the excavation outside said anchor tube, so as to form a concrete panel, after hardening of the concrete panel, a crowning structure is made overhanging the upper face of the concrete panel, so that the inside of the anchor tube remains accessible from the upper face of said structure, a cable is placed inside the anchor tube, a lower portion of the cable is fixed to a lower portion of the anchor tube, tension is exerted on the cable so as to place the cable in tension, and the cable is locked in tension with respect to the concrete panel and to the crowning structure.

12. A prestressed diaphragm wall in the ground, comprising:

a concrete panel, at least one anchor tube having an upper portion and a lower portion, and open at its upper end and closed at its lower end, and embedded at least partially in the concrete panel, at least one cable extending inside the anchor tube, a lower portion of the cable being fixed to said tube, a cable anchoring system, configured to maintain the cable in tension and secure its upper portion to an upper portion of the concrete panel.

13. The diaphragm wall according to claim 12, further including a reinforcement cage embedded in the concrete panel, the anchor tube being secured to the reinforcement cage.

14. The diaphragm wall according to claim 12, wherein the anchor tube includes a plurality of annular beads formed at its periphery.

15. The diaphragm wall according to claim 14, wherein the annular beads are formed along the lower portion of the anchor tube.

16. The diaphragm wall according to claim 14, wherein the anchor tube has a nominal diameter and, at the beads, a diameter comprised between 1.05 and 1.3 times its nominal diameter.

17. The diaphragm wall according to claim 16, wherein the anchor tube has a nominal diameter at the beads, comprised between 1.10 and 1.3 times its nominal diameter.

18. The diaphragm wall according to claim 17, wherein the anchor tube has a nominal diameter at the beads comprised between 1.15 and 1.25 times its nominal diameter.

19. The diaphragm wall according to claim 14, wherein the beads are positioned one above the other and have the same diameter.

20. The diaphragm wall according to claim 14, wherein the beads are distributed over a limited length of the anchor tube.

21. The diaphragm wall according to claim 20, wherein the beads are distributed over a limited length of the anchor tube not exceeding one-third of the total length of the anchor tube.

22. The diaphragm wall according to claim 21, wherein the beads are distributed over a limited length of the anchor tube not exceeding one-fifth of the total length of the anchor tube.

23. The diaphragm wall according to claim 12, wherein an inner wall of the lower portion of the anchor tube forms a plurality of annular cavities arranged one above the other.

24. The diaphragm wall according to claim 12, wherein a sealing material fills at least the lower portion of the anchor tube and coats at least the lower portion of the cable.

25. The diaphragm wall according to claim 12, wherein the cable consists of a plurality of strands and, in the lower portion of the cable positioned in the lower portion of the anchor tube, the strands are spaced from one another by a spacer.

26. A prestressed retaining assembly comprising:

a diaphragm wall according to claim 12, and a crowning structure capping said diaphragm wall, the cable passing through said crowning structure and the cable anchoring system being secured to the upper portion of said structure.

* * * * *